US007283146B2

(12) United States Patent
Rich

(10) Patent No.: US 7,283,146 B2
(45) Date of Patent: Oct. 16, 2007

(54) THERMAL PRINTER TEMPERATURE MANAGEMENT

(75) Inventor: David L. Rich, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 213 days.

(21) Appl. No.: 11/016,493

(22) Filed: Dec. 17, 2004

(65) Prior Publication Data

US 2006/0132583 A1 Jun. 22, 2006

(51) Int. Cl.
*B41J 2/36* (2006.01)

(52) U.S. Cl. ..... 347/188; 347/193; 347/194; 347/195

(58) Field of Classification Search ..... 347/188–196; 400/120.09–120.11, 120.13, 120.14, 120.15
See application file for complete search history.

(56) References Cited

U.S. PATENT DOCUMENTS 4,391,535 A * 7/1983 Palmer ..... 400/120.11
5,625,399 A * 4/1997 Wiklof et al. ..... 347/195
6,709,083 B2 * 3/2004 Fukushima ..... 347/17
6,819,347 B2 * 11/2004 Saquib et al. ..... 347/194

* cited by examiner

*Primary Examiner*—Huan Tran
(74) *Attorney, Agent, or Firm*—George M. Macdonald; Angelo N. Chaclas

(57) ABSTRACT

Systems and methods for providing thermal printhead thermal history temperature management by preprocessing target images are described. In one example, a thermal compensation process is applied to a target image to provide offset values in order to create a compensated image that is later printed without local printhead thermal compensation.

20 Claims, 5 Drawing Sheets

THERMAL PRINTER TEMPERATURE MANAGEMENT

BACKGROUND

The illustrative embodiments described in the present application are useful in systems including those using thermal printheads and more particularly are useful in systems including those for providing thermal printhead temperature management by preprocessing images for use with direct contact thermal printheads.

Direct contact thermal print heads are typically designed to produce heat using thermal printhead heating elements in order to activate thermal media such as a thermal media label stock. Such thermal media may be gray scale media or in some cases, color media. When used with a grayscale thermal media stock, the elements are heated to higher levels to produce a darker gray output on the thermal media label stock. The thermal printhead typically includes a linear array of resistive heating elements that are brought to increased temperatures using increased drive current. The thermal media passes over the linear array and portions of the media are activated due to the heat present at each heater element.

The typical thermal print head includes a heat sink thermally connected to the heating elements so that heating elements will more quickly cool when the drive current is removed. Thermal printhead elements may be heated relatively quickly, but cool down more slowly using a heat sink. Accordingly, the printhead temperature curve includes hysterisis. The printheads often include a thermistor that is used to measure ambient temperature at the printhead and provide feedback to the printhead processor so that the heating elements may be properly driven to achieve the desired heat and intensity on the thermal media.

The temperature hysteresis problem is more troublesome at higher printing speeds and may affect the quality of printing gray-scale or color images. For example, when a dark or high intensity pixel is printed, the print head uses a high current to achieve the heat required at the heating element for that particular thermal media. If the subsequent pixel is relatively light or low intensity, the heating element may have retained significant heat from the prior pixel printing cycle. Accordingly, the printer must compensate for the pre-heated condition of the print head in a process that is referred to as Thermal History Management. In such a situation, the printhead might not use as much drive current because the print element is already somewhat heated. The printer must also manage the overall pre-heating of the printhead heat sink that affects all nearby printing elements in a process that is referred to as Thermal or Power Management. The printhead typically includes local processing systems to perform such compensation routines and thus requires a more expensive printer controller that is capable of performing the required calculations.

Thermal printheads are available from several companies including Kyocera Industrial Ceramics Corp. of Vancouver, Wash. Such printheads are available in a variety of sizes and geometric configurations sand may be purchased having resolutions of approximately 200 through 600 dots per inch (dpi). For example, the Kyocera KSB320BA printhead includes a chip thermistor. The printheads may vary in widths including approximately 40 mm through 927 mm and in custom configurations may have narrower widths including 27 mm. Similarly, thermal printers and printheads are available from several companies including the P91DW printer available from Mitsubishi Electric of Irvine, Calif. Thermal printheads may be constructed using thick film fabrication techniques.

Thermal printer subsystems may include a thermal printhead and a control processor or ASIC. The control processors may perform thermal history management locally on the fly as an image is printed. However, such systems require additional components and/or software to perform such hardware real-time thermal history management. A print control device and method of printing using the device is described in U.S. Pat. No. 6,709,083 B2, issued Mar. 23, 2004 to Fukushima. Fukishima describes a hardware temperature management circuit and feedback scheme for controlling heating element temperature.

Many thermal printheads are designed to operate as generic printers using standard printer software drivers to accommodate arbitrary images that are sent to the printer. The prior art does not provide a system and method for providing thermal printhead thermal history management and compensation in an external device.

SUMMARY

Accordingly, it is an object of the present application to describe systems and methods for providing thermal printhead thermal history temperature management by preprocessing target images.

For example, in one illustrative embodiment, a thermal compensation process is applied to a target image to provide offset values in order to create a compensated image that is printed.

In another illustrative embodiment, a quality parameter is used to allow sub-optimal output to increase printer speed.

In yet another illustrative embodiment, a printhead and media compensation overlay is developed for use in a generic compensation process.

Therefore, it should now be apparent that the invention substantially achieves all the above aspects and advantages. Additional aspects and advantages of the invention will be set forth in the description that follows. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

Illustrative systems and methods useful for determining a thermal printer history and/or temperature management process for a thermal printhead and a thermal media are described. Additionally, systems and methods useful for applying a thermal printer history and/or temperature management system are described.

Figure 1:
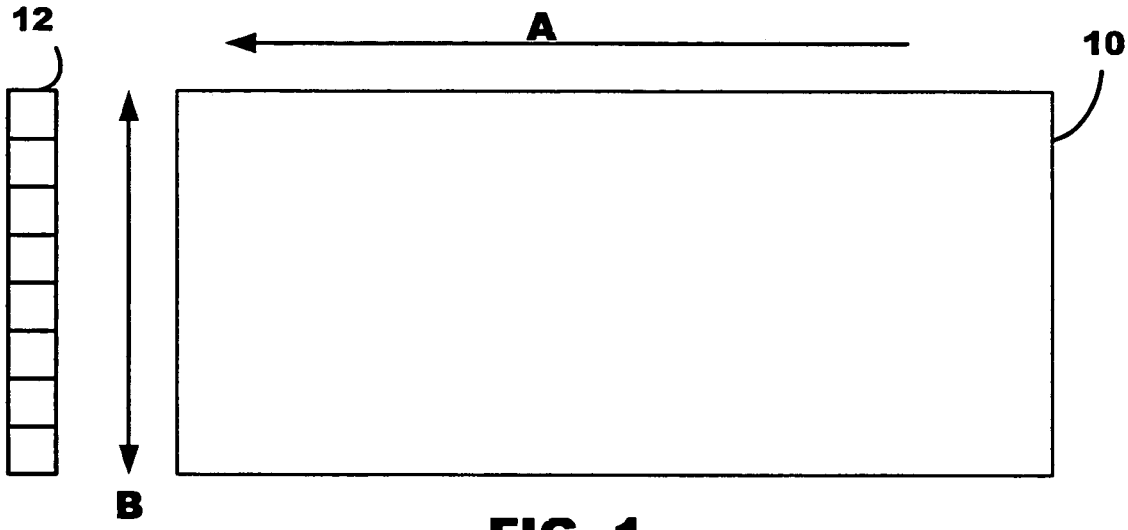
FIG. 1 is a schematic top view of an illustrative blank thermal media label and a thermal printhead array according to an illustrative embodiment of the present application.

Referring to FIG. 1, a schematic top view of a blank thermal media label and a thermal printhead array according to an illustrative embodiment of the present application is shown. The thermal media 10 is a gray-scale thermal label that is fed in direction A across a thermal printhead 12 that includes a linear array of heating elements. The media 10 has a width B that is approximately 1.5 inches wide. The media described is for illustrative purposes. In alternatives, the thermal media may be of a different width as appropriate, maybe coated, may be a color media and may be in different format such as a roll media.

Figure 2A:
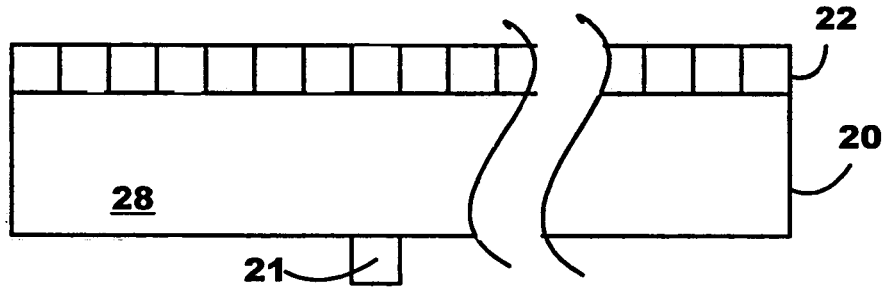
FIG. 2A is a schematic side view of an illustrative thermal printhead according to an illustrative embodiment of the present application.

Referring to FIG. 2A, a schematic side view of an illustrative thermal printhead according to an illustrative embodiment of the present application is shown. Thermal printhead 20 includes an array of heating elements 22 and a heatsink 28. The printhead also includes a thermistor 21 that is used for measuring the temperature of the device. The thermal printer typically includes a printer controller for controlling the drive circuits that heat the array of heating elements 22. The printer controller may include a generic microcontroller that is programmed to perform printer controller functions or a custom ASIC.

Figure 2B:
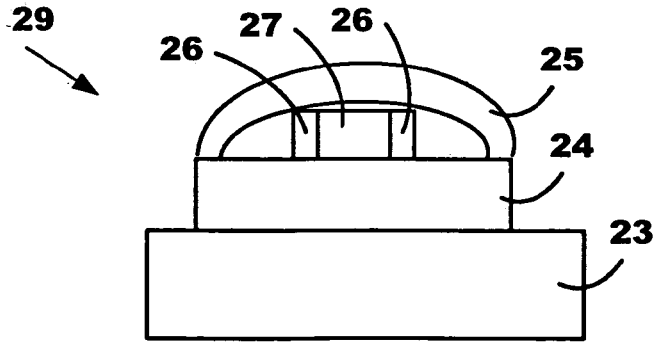
FIG. 2B is a schematic side cutaway view of a thermal printhead heating element according to the illustrative embodiment of a the present application shown in FIG. 2A.

Referring to FIG. 2B, a schematic side cutaway view of a thermal printhead heating element as used in thermal printhead 20 is shown. The thermal printhead described is illustrative and could be replaced with other similar printheads such as the Kyocera KSB320BA. A resistive heating element 27 is connected to electrodes 26 that provide a drive current to heat the element 27. A wear layer 25 is placed over the heating element 27 and is used to directly contact the thermal media. The thermal media is typically fed through a paper handling device such as a roller that biases the thermal media into contact with the wear layer 25 the resistive heating element 27 is deposited on a ceramic substrate 24 that is deposited on an aluminum heatsink 23 the heatsink 23 is used for facilitating removal of heat from the heating element 27 after the drive circuit removes the drive current.

In certain thermal printing applications, especially when they are printing at relatively high speeds, thermal history management and thermal compensation may be required to achieve adequate print quality. Many thermal printers are designed for use as a generic printer that must print arbitrary image data as it is sent to the printer. If those printers were to employ thermal history management and/or thermal compensation, such functions might be performed locally at the printhead by a dedicated controller. Such processing might also result in a processing delay and therefore slower print speeds.

Figure 3A:
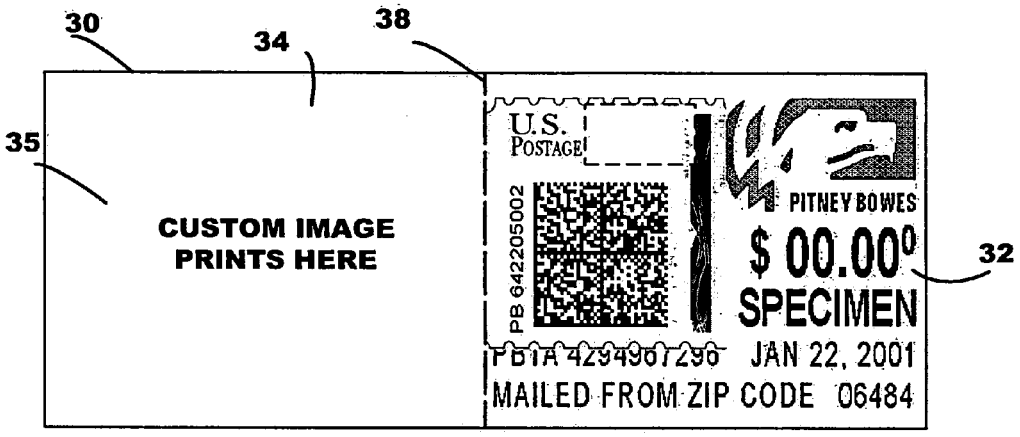
FIGS. 3A and 3B are top plan views of an illustrative signaling thermal label media according to an illustrative embodiment of the present application.
Figure 3B:
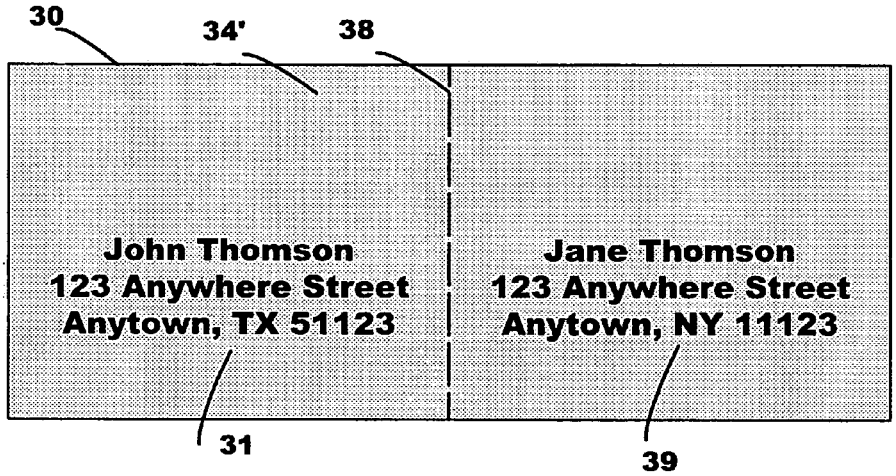

Referring to FIGS. 3A and 3B, top plan views of an illustrative signaling thermal label media according to an illustrative embodiment of the present application are shown. Referring to FIG. 3A, a gray-scale thermal label 30 includes a white background 34 and is perforated by perforation 38. The left half of the label 35 includes a custom gray-scale image. The right half of the label 32 includes a postage indicia. In an alternative, the label is a color thermal media. Referring to FIG. 3B, a gray-scale thermal label 30 includes a background 34' that may include some gray pixels and is perforated by perforation 38. The left half of the label 31 includes an address label and the right half of the label 39 includes an address label. In an alternative, a single address label spans both halves of label 30.

The labels 30 comprise a modified Mitsubishi K615-ce direct thermal media having a signaling section such as a coating of a taggant material such as a luminescent material. The labels 10 may be pre-cut to have a standard length such as 2.6 inches or perforated to have two 1.3 inch halves. Alternatively, the label stock may be continuous and may be cut to the appropriate length or torn off the roll after the printing process. The 2.6-inch pre-cut labels may be further perforated so that two label halves may be separately utilized. In yet another embodiment, a thermal media label roll may include 1.3 inch labels that may be used two at a time to create an aggregated 2.6 inch long label or one at a time to utilize only a 1.3 inch long label. The label may also include a pre-formed image or a pre-printed image on the blank label stock. In the embodiments described, thermal printers having a 32 level gray scale and a 256 level gray scale range with appropriate media is utilized. One printer used is the 256 gray scale level 260 dpi model P91DW thermal printer available from Mitsubishi Electric of Irvine Calif. However, other thermal printers and media may be used.

In at least some of the illustrative embodiments described herein, the target image to be printed relates to postage payment evidencing and is known and can be pre-processed before being sent to the thermal printer. The target image may be processed to add security features and in an alternative embodiment, the security feature processing and the thermal printer history and/or temperature management compensation can be performed off the printhead such as by a host processor of a system including a thermal printer, a host personal computer that communicates with the thermal printer or by a data center processor or other server at a remote location.

The thermal printer history and/or temperature management routines may be performed using an external general-purpose processor such as a personal computer or data center server programmed to execute the processes described. Accordingly, the thermal history and temperature management problems are moved from the printer controller to an external device such as the device that prepares a gray-scale image for printing. Such a system does not require real-time thermal history and temperature management processing at the printhead controller and thus reduces the processor power required at the printhead and may improve print speeds. Because such a system requires less processing power in the printing device, the printing controller may be less sophisticated and less expensive. The printer may produce higher quality prints at higher print speeds. Additionally, the printer costs may be lower and the printer may require less development time and cost.

In at least one embodiment, the thermal printer history and temperature management routines include a graphic analysis of the target image that is to be printed. An external processor is likely to have significantly more computing power than the printer controller. The external processor can perform an analysis of the image to be printed. In the case of a gray-scale image, the values of each pixel can be adjusted to achieve the thermal printer history and temperature management compensation in the external driving device. The image to be printed would be delivered to the printer as a pre-compensated gray-scale image such as a bitmap image that would require no additional compensation processing by the printer controller.

Thermal printing systems are designed to work with certain thermal media types. A thermal printer may be programmed to provide a certain heat at a certain pixel location of the linear heating element array for a certain period of time. The heating element may be driven by a square wave or other appropriate waveform. However, different types of thermal media react to heat differently. For example, two different types of thermal gray-scale media may require a different heat application to achieve the same optical density.

In some applications described herein, the target image may not require relatively high quality printing. For example, in printing an address label having black text, the label might be acceptable if black text were printed on a somewhat gray background rather than a white background of a blank label. Accordingly, the system may provide for faster printing speeds if sufficient contrast is achieved. For example, the system might not require the printhead to cool down sufficiently to not mark the background pixels.

Figure 4:
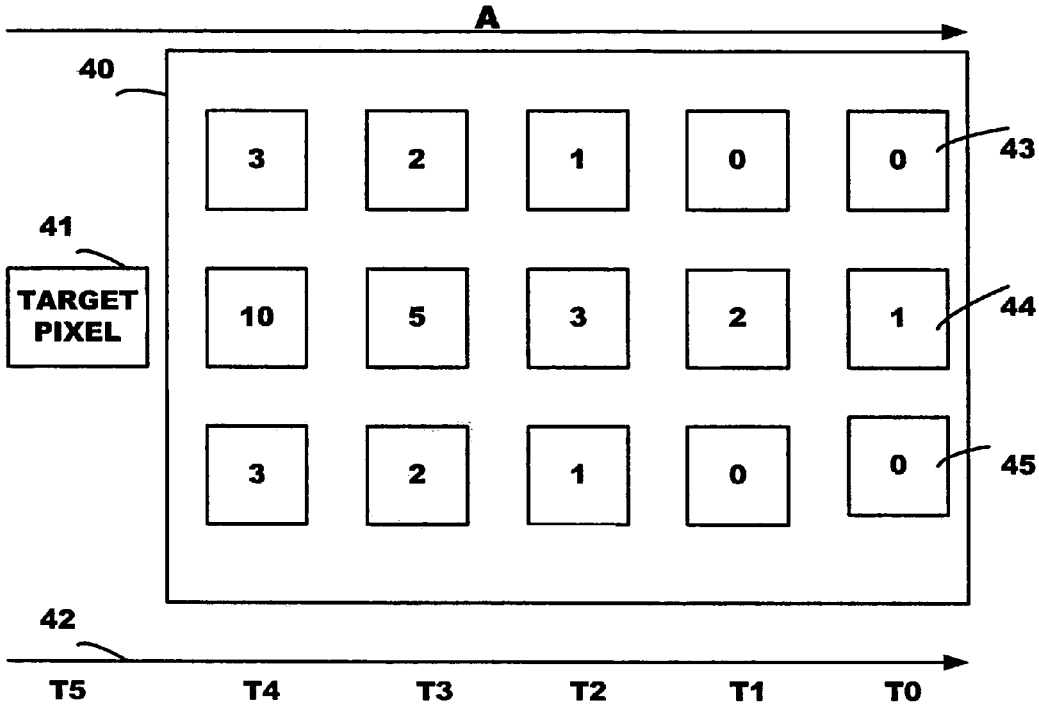
FIG. 4 is a schematic view of a printhead thermal history according to an illustrative embodiment of the present application.

Referring to FIG. 4, a schematic view of a printhead thermal history according to an illustrative embodiment of the present application is shown. Prior pixel values 40 are shown in columns 43, 44, 45 along the direction of the thermal media travel A. The numbers shown in the pixel boxes represent the relative weight or heating effect that these printed pixels may have on the target pixel. The pixels are shown along timeline 42 as they would be printed at times T0 through the time T5 corresponding to the target pixel 41. The analysis is performed on the original image with any required intermediate images stored in scratch memory to result in a modified image that is compensated for thermal printer history and/or temperature management effects.

On one illustrative embodiment of the present application, thermal history management is achieved using a two pixel look-back process. In an alternative, a three pixel look-back process is used. The gray scale value of each pixel in a print row is adjusted upward (more power) or downward (less Power) to deliver a corrected heating value to each print element depending on the pre-heating effects of the previous pixels printed. The adjusted value delivers the proper heat to the print element to produce the intended gray-scale image having the intensities specified by the original gray scale bitmap. This value is then further adjusted using thermal management analysis. Each printed pixel adds some heat to the heat sink having both a local and overall affect on heatsink temperature. The heatsink temperature affect asserted on a single print element is most affected by the heating affects contributed by neighboring heating elements. This local heatsink temperature can be calculated and an accurate adjustment made to the gray scale value to provide additional compensation.

Figure 5:
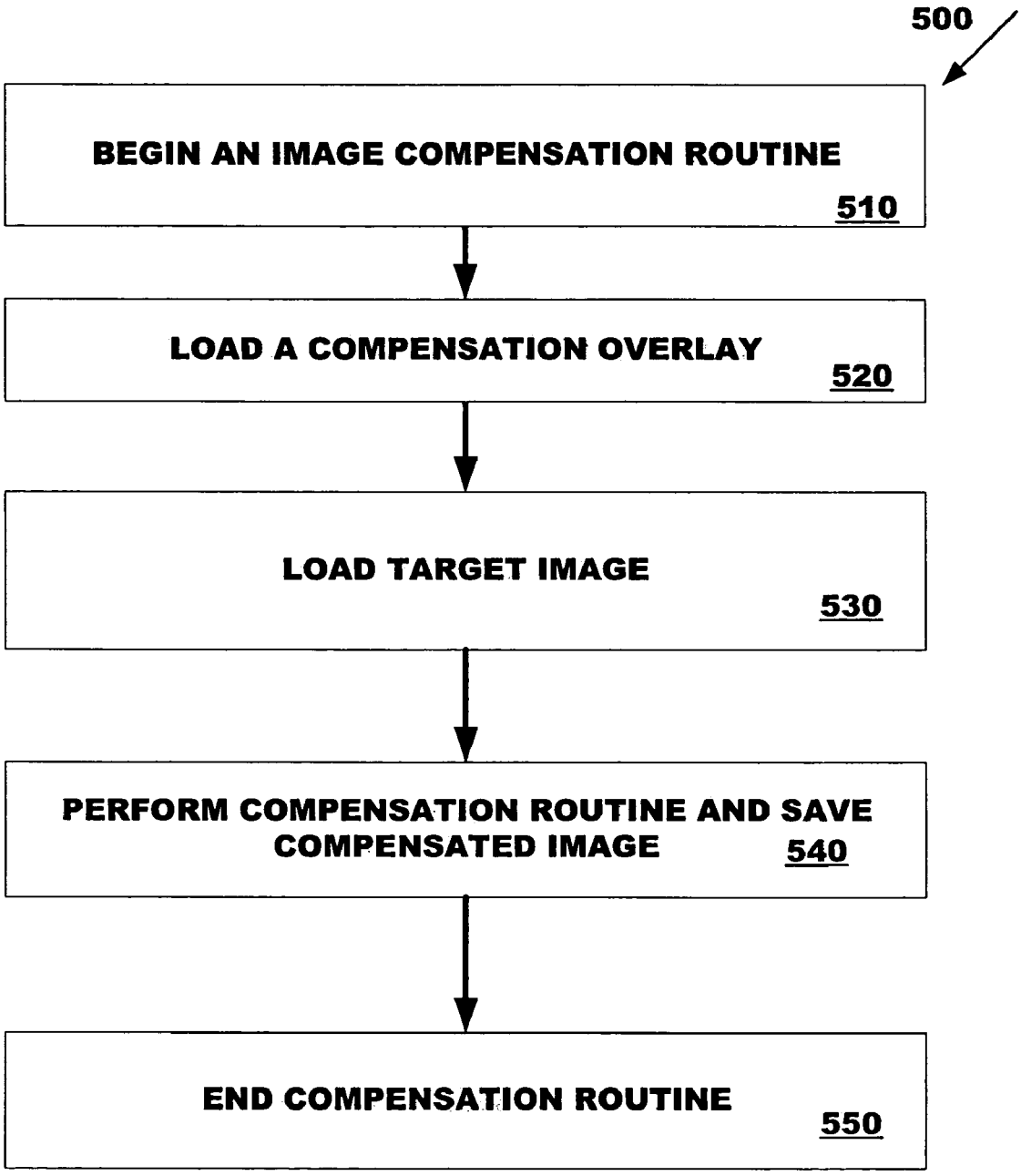
FIG. 5 is a flow chart showing a process for applying a thermal printer history and temperature management system according to an illustrative embodiment of the present application.

Referring to FIG. 5 is a flow chart showing a process 500 for applying a thermal printer history and temperature management process for a thermal printhead and a thermal media according to an illustrative embodiment of the present application is shown. Thermal printheads used to print continuous gray-scale images produce local heating effects surrounding each print head pixel element as well as overall heating effects on the surrounding heat sink. Many printers seek to compensate for these effects by calculating a gray-scale offset based on recently printed pixels in the printer hardware.

In the illustrative compensation process described here, a 32 gray level thermal printer is used with appropriate media. Alternatively, the process can be modified to accommodate any number of gray levels such as 256 gray levels. In a 32 gray level scheme, a single 8 bit byte of data can be used to hold the 5 bit gray level value and a 3 bit compensation value for each pixel. The compensation or adjustment data would be contained in the upper 3 bits of the byte. Accordingly, if the compensation value is signed, a signed range of plus or minus 4 levels of adjustment is possible. In this way, the pre-processed graphic image could be used on printers with built-in thermal history management by masking off the adjustment bits. Printers with no thermal history management would add the adjustment value to the gray level represented by the lower 5 bits. The pixel byte would contain the nominal gray level in bits 0-4, the least significant adjustment bit in bit 5, the most significant pixel bit in bit 6 and the adjustment sign bit in bit 7.

In step 510, the compensation process 500 begins. In step 520, the process loads the compensation overlay associated with a printhead/media combination. In step 530, the process loads the target image. In step 540, the process applies the adjustment to each pixel of the target image as a target pixel as described below. In step 550, the process ends.

Referring to FIG. 4 and FIG. 5, the process 500 is illustrated with an example. The thermal printer is capable of printing 32 levels of gray with level 1 representing white and level 32 representing black. If the target pixel 41 is nominally a mid gray level of 15, then this value may be adjusted up or down several gray levels based on the ambient heat sink temperature and the recent thermal history of the pixel element and its neighbors. Level 15 gray is produced by looking up a pulse pattern in a 2 dimensional table that is indexed by both the heat sink temperature and the desired gray-scale. The table lookup for gray scale level 15 and a particular heat sink temperature would return a bit pattern of power pulses to produce an accurate level 15 gray for the given heat sink temperature. That gray level index would be further offset by the thermal history adjustment calculation. The offset is the weighted average gray level of the history matrix subtracted from the nominal desired gray level for the target pixel multiplied by an appropriate power factor P. The power factor P is derived empirically for a particular printhead to provide desired results that may be optimized for printing parameters such as speed and optimum consistent quality results. In this calculation, the gray levels begin at zero and end at level 31.

In the following equations, T represents the target pixel, L represents the left neighbor of the target pixel and R represents the right neighbor. The subscripts for each element represent the history index, where index 1 represents the most recently printed pixel gray level. To calculate the gray-level offset for the target pixel, the products of the gray levels and weighting factors of the history matrix are summed. Using the weighting factors of the above example, the thermal history offset is calculated using the following formula:

$$\text{Adjustment}=P\{\text{Gray level } T\text{nom}-[(10T1+5T2+3T3+2T4+T5+3L1+2L2+L3+3R1+2R2+R3]/\text{Sum (weights)}\} \quad \text{EQ(1)},$$

where Gray-Level Tnom is the unadjusted gray-level for the target pixel and P is a power factor to limit the range of adjustment allowed in a lookup table index such that it is generally limited to 2-3 gray levels. Variables T1-T5 are the gray levels (in a value range of 0-31) to be printed in the preceding pixels, positive or negative. Variables L1-L3 are the gray levels (in a value range of 0-31) to be printed in the preceding left neighbor pixels, positive or negative. Variables R1-R3 are the gray levels (in a value range of 0-31) to be printed in preceding right neighbor pixels, positive or negative.

In the above example, if all historical pixels were to print a mid-gray level (15) in recent history, the algorithm would return an adjustment value of zero (0) as shown in the following reduction of Equation 1:

$$\text{Adjustment}=P(15-15)=0 \text{ Gray levels} \qquad \text{EQ(2).}$$

If all of the historic pixels were to print pure black (gray level 32) the adjustment would result in a negative adjustment as shown in the following reduction of Equation 1:

$$\text{Adjustment}=P(15-31)=-16P \text{ Gray levels} \qquad \text{EQ(3).}$$

The Power factor P would be set to give the optimum adjustment range for a particular print head. Empirical testing with illustrative printhead/media combinations indicate that the power factor P should be not more than +/−2-3 gray levels over the extreme ranges of the pixel history. In this case, a power factor of 0.18 fits fairly well and results in a −2.88 gray level adjustment in the previous example (i.e. $-16\times0.18=-2.88$) that is rounded to give an adjustment of −3 gray-levels for this example.

In another alternative embodiment, the original target image is defined as a low quality image. For example, the address label shown in FIG. 3B is designated low quality. Although the target image is a black image on a white background, the process adds gray levels to the background so that the printer elements are not required to cool down and printing speed may be increased.

Figure 6:
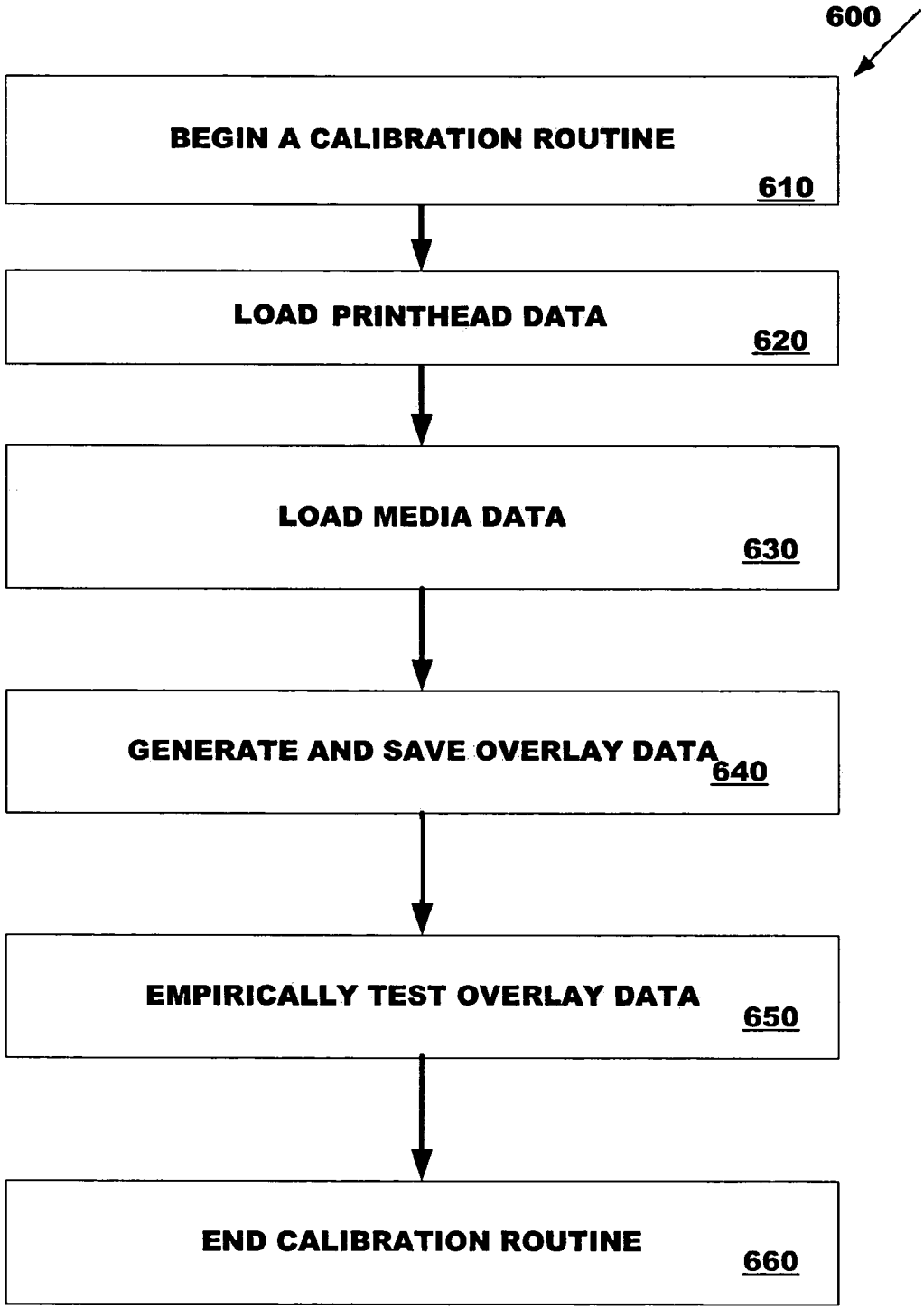
FIG. 6 is a flow chart showing a process for determining a thermal printer history and temperature management process for a thermal printhead and a thermal media according to an illustrative embodiment of the present application.

Referring to FIG. 6 is a flow chart showing a process 600 for determining a thermal printer history and temperature management process for a thermal printhead and a thermal media according to an illustrative embodiment of the present application is shown.

As described, each thermal printhead and thermal media combination has a set of characteristics. For example, the heat curve required to achieve optical densities corresponding to a linear scale of 1-256 or 1-32 pixel gray scale intensity values may not be a linear heat curve. Accordingly, a printhead/media overlay can be applied to a compensation algorithm for the particular combination. In addition, the graphic image can be processed for various different printers by using different, printhead or printer specific weighting factors in the gray-scale adjustments. Each print head will have a specific calibration overlay for its unique mechanical design and thermal characteristics.

In step 610, the printer/media overlay generation process 600 begins. In step 620, the printhead characteristics are selected from a table or loaded. The characteristics include the number of gray scale values permitted and the heating profile for those values including whether the heat applied is linear. In step 630, the media characteristics are selected from a table or loaded. The characteristics include the number of gray scale values permitted and the heating profile for those values including whether the heat applied is linear. The media characteristics may be generated by selecting a gray scale value for the printer and observing the optical density produced on the media. In step 640, the overlay is generated providing a table of power factors to be applied in the process described with reference to FIG. 5. In step 650, the overlay is tested using the application algorithm of FIG. 5 and if necessary, adjustments are made to the overlay. In step 660, the overlay generation process ends.

In another alternative embodiment, the original target image is first pre-processed to add additional features such as security features including watermarking and then processed for thermal compensation. In yet another alternative, the original target image is first pre-processed to provide thermal compensation and then pre-processed to provide additional features such as security features.

The present application describes illustrative embodiments of thermal media labels and systems and methods for providing selective signaling. The embodiments are illustrative and not intended to present an exhaustive list of possible configurations. Where alternative elements are described, they are understood to fully describe alternative embodiments without repeating common elements whether or not expressly stated to so relate. Similarly, alternatives described for elements used in more than one embodiment are understood to describe alternative embodiments for each of the described embodiments having that element.

The described embodiments are illustrative and the above description may indicate to those skilled in the art additional ways in which the principles of this invention may be used without departing from the spirit of the invention. Accordingly, the scope of each of the claims is not to be limited by the particular embodiments described.

What is claimed is:

1. A method for applying thermal compensation to a target image in an external processor to produce a compensated image for use with at least one thermal printer having thermal response characteristics comprising:

obtaining compensation overlay data associated with the at least one thermal printer;

obtaining the target image;

performing a pre-computed thermal compensation routine on the target image using the external processor to produce a compensated image using the compensation overlay data; and saving the compensated image for later use in printing to the at least one thermal printer.

2. The method of claim 1, wherein:

the compensation overlay data corresponds to a thermal printhead model.

3. The method of claim 1, wherein:

the compensation overlay data corresponds to a thermal media model.

4. The method of claim 1, wherein:

the compensation overlay data corresponds to a thermal printhead model and a thermal media model.

5. The method of claim 1, wherein:

the thermal compensation routine determines the compensated image using each target pixel and preceding pixel value data for pixels in the target pixel column.

6. The method of claim 5, wherein:

the thermal compensation routine determines the compensated image using each target pixel and preceding pixel value data for pixels in the target pixel column and for pixels in columns adjacent to the target pixel.

7. The method of claim 1, wherein:

the compensation overlay data includes a power factor corresponding to a thermal printhead model.

8. The method of claim 1, wherein:

the compensated image includes pixel data including pixel data representing the pixel values of the target image and an offset value.

9. The method of claim 8, wherein:

the offset value is a signed value.

10. The method of claim 6, wherein:

the compensated image is determined using an adjustment value for each pixel that is determined using the equation $$\text{adjustment value}=P\{\text{Gray level } T\text{nom}-[(10T1+5T2+3T3+2T4+T5+3L1+2L2+L3+3R1+2R2+R3]/\text{Sum (weights)}\}.$$

11. The method of claim 9, wherein:

the offset value is determined using the equation $$\text{offset value}=P\{\text{Gray level } T\text{nom}-[(10T1+5T2+3T3+2T4+T5+3L1+2L2+L3+3R1+2R2+R3]/\text{Sum (weights)}\}.$$

12. The method of claim 1, wherein:

the target image is a 32 level gray scale image.

13. The method of claim 1, wherein:

the compensated image includes the target image and a signed 4-level gray scale adjustment value.

14. The method of claim 1, wherein:

the compensation overlay data is provided for a type of thermal printer using a type of thermal media.

15. The method of claim 1, wherein:

the compensation overlay data is calibrated for an individual thermal printer of a type of thermal printers.

16. The method of claim 1, wherein:

the compensation overlay data is calibrated for an individual thermal printer of a type of thermal printers using a type of thermal media.

17. A method for producing a thermal compensation overlay comprising:

obtaining generic printhead thermal data for a type of thermal printer;

obtaining thermal media data; and generating generic overlay data for the type of thermal printer using the printhead data and the thermal media data;

obtaining printhead thermal data for an individual thermal printer of a type of thermal printer; and generating offset overlay data for individual thermal printer for modifying the generic overlay data.

18. The method of claim 17, wherein:

the overlay data includes a thermal printhead power factor.

19. A method for applying thermal compensation to a target image for use with at least one thermal printer having thermal response characteristics comprising:

obtaining compensation overlay data associated with the at least one thermal printer;

obtaining the target image;

determining a quality value for the target image;

performing a pre-computed thermal compensation routine on the target image to produce a compensated image using the compensation overlay data and the quality value; and saving the compensated image for later use in printing to the at least one thermal printer.

20. The method of claim 19, wherein:

if the quality value is low, the thermal compensation routine adds gray levels to white values of the target image.

* * * * *